United States Patent [19]

Harris et al.

[11] Patent Number: 4,524,755

[45] Date of Patent: Jun. 25, 1985

[54] FRICTION HEAT GENERATOR

[76] Inventors: Harold D. Harris, 5518 Ogden St., Omaha, Nebr. 68104; Thomas J. Harris, 10636 Ellison Plz. #1, Omaha, Nebr. 68134

[21] Appl. No.: 596,967

[22] Filed: Apr. 5, 1984

[51] Int. Cl.[3] ..... F24C 9/00

[52] U.S. Cl. ..... 126/247; 122/26; 188/251 A

[58] Field of Search ..... 126/247; 122/26; 165/86, 89; 416/119, 117, 4; 188/73.1, 218 XL, 250 B, 251 A, 251 R; 192/107 M

[56] References Cited

U.S. PATENT DOCUMENTS

| | | | |
|---|---|---|---|
| 1,130,720 | 3/1915 | Ewers | 122/26 X |
| 1,919,681 | 7/1933 | Anderson | 122/26 |
| 2,226,423 | 12/1940 | Blake | 122/26 |
| 2,251,344 | 8/1941 | Tesch | 122/26 |
| 2,625,929 | 1/1953 | Love et al. | 122/26 X |
| 3,895,693 | 7/1975 | Lucien et al. | 188/218 XL X |
| 3,923,128 | 12/1975 | Lucien et al. | 188/251 A |
| 4,007,814 | 2/1977 | Berger | 188/218 XL |
| 4,285,329 | 8/1981 | Moline . | |
| 4,343,291 | 3/1982 | Clausen . | |
| 4,377,202 | 3/1983 | Nakamura et al. | 165/86 |
| 4,381,762 | 5/1983 | Ernst . | |
| 4,388,915 | 6/1983 | Shafran . | |

FOREIGN PATENT DOCUMENTS

| | | | |
|---|---|---|---|
| 7044 | 1/1977 | Japan | 126/247 |

*Primary Examiner*—Randall L. Green
*Attorney, Agent, or Firm*—William H. Wright

[57] ABSTRACT

An improved friction heater apparatus (10) comprises a thin walled metallic drum (25) sealed on both ends, having a centrally disposed axle (14) mounted therein, and a plurality of free floating friction elements (16) operatively associated with the axle (14), wherein the rotary motion of the axle will impart centrifugal force to the friction elements to radially displace the friction elements with respect to the axle, and into engagement with the wall of the metallic drum (25).

5 Claims, 8 Drawing Figures

FIG. 1.
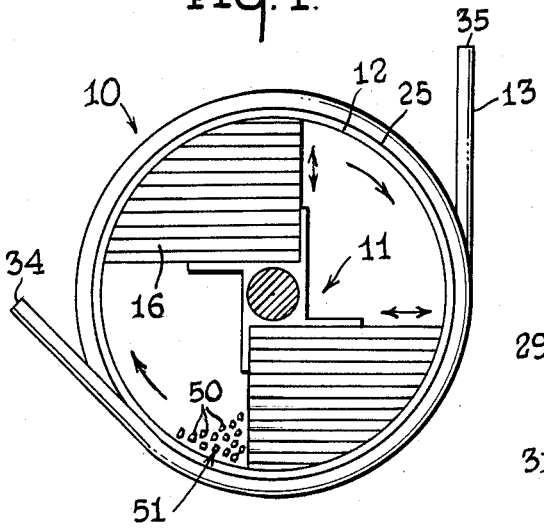
FIG. 2.
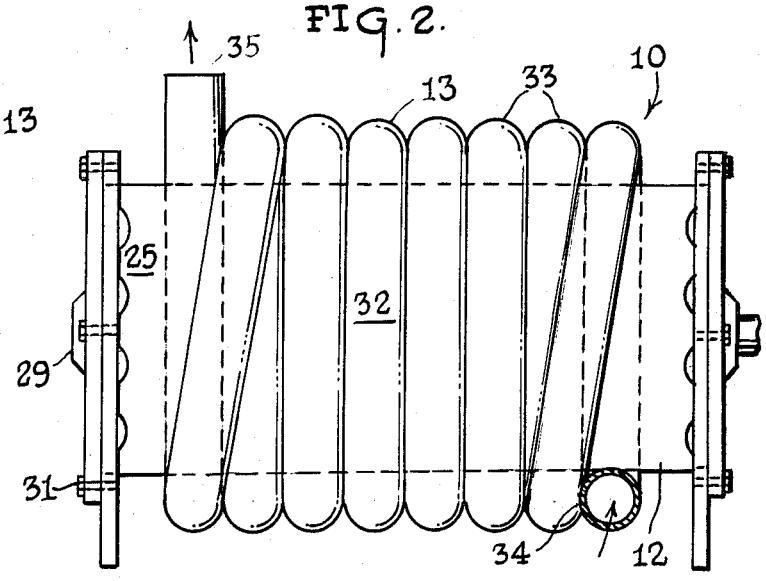
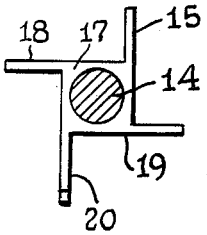
FIG. 3.
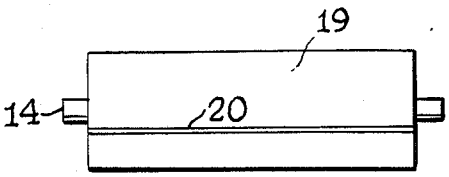
FIG. 4.
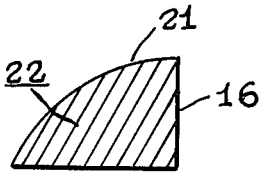
FIG. 5.
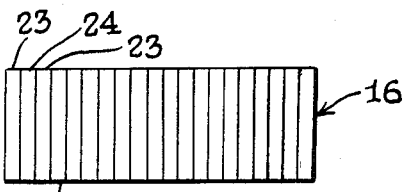
FIG. 6.
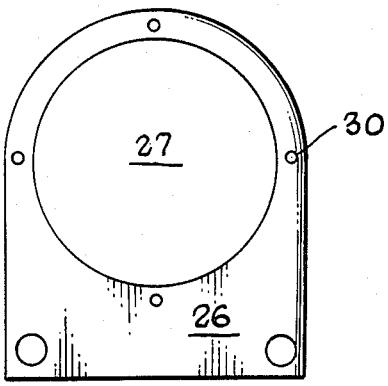
FIG. 7.
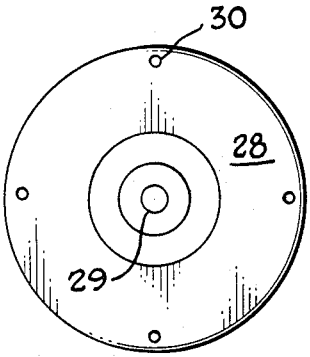
FIG. 8.

FRICTION HEAT GENERATOR

TECHNICAL FIELD

This invention relates generally to apparatus that have portions that frictionally engage one another, or an intermediate fluid medium, to create heat which is passed by a heat exchange process to an outside source.

BACKGROUND ART

The search for a heat source or generator, that does not produce contaminents or pollutants as a by-product, has led innovators to closed loop heating systems initially, and ultimately to a type of apparatus that is commonly referred to as a friction heater.

The basic principles surrounding this type of an apparatus are a closed loop heating source and a heat exchange process, for transferring the generated heat away from the heat generator.

Most prior art devices employ the same basic structures in their operation, i.e., friction generating surfaces moved relative to one another, and a fluid medium such as air or liquid for heat transfer.

Some of the prior art devices rely on convection for the heat transfer process.

Other prior art devices rely on conduction for the heat transfer process.

Still other prior art devices rely on a combination of convection and conduction for the heat transfer process.

Examples of some of the aforementioned prior art devices may be seen be reference to U.S. Pat. Nos.: 4,388,915; 4,381,762; 4,343,291 and 4,285,329.

While all of the aforementioned devices are adequate for their intended purpose, and function in accordance with the well recognized principles enumerated supra; they are deficient both in the complexity of their design, and in their failure to compensate for the inevitable deterioration and subsequent increased spacing between the friction survaces, which results in the decreased heating capacity of the system in which the apparatus is employed.

For the aforementioned reasons, the prior art devices are extremely expensive to fabricate and maintain, and require frequent replacement of the friction surfaces, when only a relatively small portion of the friction material has been consumed by the heating process.

DISCLOSURE OF THE INVENTION

The above stated problems are substantially resolved by the provision of the instant invention. The instant invention includes generally a fluid conduction conduit unit, that surrounds a friction heat generating drum unit, that contains a simple yet unique friction heat producing means.

The friction heat producing means includes generally an axle member rotatably disposed within the drum unit, and a plurality of friction blocks that are operatively connected to the axial member, but radially displaceable with respect thereto, in order to frictionally engage the interior surface of the drum unit.

The radial displacement of the friction blocks, insures that the friction blocks will always be in positive contact with the walls of the drum unit, when the device is operational; and furthermore will maintain that contact despite the wear or deterioration of the friction material surface. In addition the friction material particles that are produced by the degradation of the friction blocks will not only provide lubricating particles; but will also provide a loose mass of friction material that will be swept around the interior walls of the heating drum by the intact portions of the friction blocks.

The friction blocks are fabricated from a carbon-graphite composite material, or alternately disposed arcuate segments of carbon and graphite material. The carbon component is chosen primarily for its friction producing characteristics, and the graphite component is chosed primarily for its lubricating properties.

The frictional contact, imparted by the friction blocks with the wall of the heating drum, heats the drum wall. The drum wall, which is in intimate contact with the fluid conduction conduit, heats the conduit walls which have forced air passing therethrough to remove the generated heat to a remote source.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is an end view of the internal and external components surrounding the heating drum;

FIG. 2 is a side view of the friction heating apparatus;

FIG. 3 is an end view of the drum axle;

FIG. 4 is a side view of the drum axle;

FIG. 5 is an end view of one of the friction blocks;

FIG. 6 is a side view of one of the friction blocks;

FIG. 7 is an elevational view of one of the end support plates for the heating drum; and FIG. 8 is an elevational view of the cover plate that seals one end of the heating drum.

BEST MODE FOR CARRYING OUT THE INVENTION

Referring now to the drawings, and in particular to FIGS. 1 and 2, the apparatus may be seen as depicted generally by the numeral 10. The apparatus (10)includes generally a friction heat generating unit (11), a friction heat drum unit (12) and a fluid conduction conduit unit (13). Each of these units will now be described in seriatim fashion.

The friction heat generating unit (11) may be comprised of an axle member (14), an elongated axle spindle element (15), and a plurality of friction block elements (16). The axle spindle element (15) has generally square main body (17) having a plurality of axially offset members (18) projection outwardly from the corners of the spindle body (17). The disposition of the leg members (18) on the spindle body (17) is such; that each face of the spindle element has an elongated surface (19) disposed perpendicular to a relatively short surface (20); and these surfaces (19) and (20) form a support surface for the friction block elements (16).

The friction block element (16) comprises an arcuate elongated segment of friction material (21). The friction material (21) may comprise a single composite carbon graphite block (22) formed as an elongated arcuate segment, or alternating discrete segments of carbon (23) and graphite (24) foined together to form the elongated arcuate segment.

The friction heat drum unit (12) comprises an elongated thin walled cylindrical drum element (25) whose ends are provided with closure means that comprise; end support plates (26), having an enlarged aperture

(27) formed therein, and dimensioned to receive one end of the drum element (25); and cover plates (28) having a centrally disposed hub portions (29) provided therein, that are dimensioned to rotatably receive the axle member (14). The cover plates (28) and support plates (26) are provided with complimentary apertures (30) that are dimensioned to receive securing means (31) that join the cover plates to the support plates to sealingly enclose the ends of the drum element (25).

The fluid conduction conduit unit (13) comprises an elongated length of flexible metal tubing (32) that is wrapped around the metal drum element (25) in a series of tightly wrapped coils (33) that are in intimate contact with one another, and with the exterior surface of the metal drum element (25). The conduit unit (13) has an inlet end (34) and an outlet end (35) for receiving and returning forced air from a remote location (not shown).

The operation of the apparatus (10) proceeds as follows:

The axle member (14) is operatively connected to a motor (not shown) that will impart rotary motion to the axle member (14). As the axle member (14) rotates in the clockwise direction as shown in FIG. 1, the elongated surfaces (19) of the axle spindle element (15) forces the free floating friction block elements (16) via centrifugal force into contact with the interior wall of the metal drum element (25). This frictional contact heats up the thin metal walls of the drum (25), and the heat from the drum (25) is imparted by conduction to the walls of the coils (33) of the fluid conduction conduit unit (13). The forced air passing through the coils (33) of the metal tubing absorbs the conducted heat from the drum (25) and removes the heat to a remote location.

It should particularly be noted that the free floating disposition of the friction blocks (16) on the axle spindle element (15) virtually eliminates problems associated with the wear imparted to the friction material (21) due to prolonged rubbing contact with the walls of the drum (25). The rotary movement of the friction material on the walls of the drum should produce an even wear pattern on the outer edge of the arcuate segment; and the centrifugal force imparted to the segment will insure that the unworn portion of the friction material will be forced into constant rubbing contact with the walls of the drum when the apparatus is operational.

As state supra, the carbon materials primary function is to produce friction, and the graphite materials primary function is to provide lubrication between the frictionally contacting surfaces. Obviously the continual abrasive contact of the respective surfaces will cause a portion of the friction material to degrade into discrete particles (50). As these particles accumulate, they will form a loose mass of particles (51) that will be swept around the interior of the drum (25) by the leading edge of the friction elements (16). This mass of particles effectively increases the effective surface area of the friction elements (16), as the friction elements are actually in the process of disintegration. This later phenomenon is a direct consequence of the unique construction of the apparatus, as well as the specifically designed cooperation between the respective components.

Obviously, many modifications and variations of the present invention are possible in light of the above teachings. It is therefore to be understood that within the scope of the appended Claims, the invention may be practiced otherwise than as specifically described.

I claim:

1. An improved friction heater apparatus consisting of:

an elongated thin, walled metallic friction drum sealed on both end and having an elongated axle member centrally journaled therein;

an elongated axle spindle element comprising a generally rectangular main body surrounding the axle member and mounted thereto, and having a plurality of leg members projecting outwardly from the corners of the spindle body, wherein the leg members are axially off-set from the spindle body and create a plurality of enlarged support surfaces and a plurality of relatively short support surfaces that generally divide the interior of said drum into axially offset quadrants; and, a pair of free floating arcurate friction block elements occupying only two of the four axially offset quadrants wherein the pair of friction block elements are offset from one another, and wherein the the unoccupied axially offset quadrants are adapted to receive a mass of detached particles from the friction block elements, whereby the mass of particles are swept around the interior of the drum by the leading edges of the friction block elements under the influence of centrifugal force imparted to the said pair of friction block elements by the spindle element.

2. An improved friction heater apparatus as in claim 1 further comprising:

an elongated length of metallic tubing, spirally wound around the exterior surface of the friction drum in a series of tightly wrapped coils, that are in intimate contact with one another and the exterior surface of the friction drum.

3. An improved friction heater apparatus as in claim 1; herein the friction block elements comprise an elongated arcurate segment of friction material.

4. An improved friction heater apparatus as in claim 3 wherein the friction material comprises:

a single composite carbon graphite block

5. An improved friction heater apparatus as in claim 3; wherein the friction material comprises alternating discrete segments of carbon and graphite joined together to form an elongated arcurate segment.

* * * * *